United States Patent [19]

Netzel

[11] Patent Number: 5,067,282

[45] Date of Patent: Nov. 26, 1991

[54] METHOD AND APPARATUS FOR NON-CONTACT MEASURING AND, IN CASE, ABRASIVE WORKING OF SURFACES

[75] Inventor: Karl-Hermann Netzel

[73] Assignee: HPO Hanseatische Prazisions-und Orbittechnik GmbH, Fahrenheitstrasse, Fed. Rep. of Germany

[21] Appl. No.: 625,640

[22] Filed: Dec. 7, 1990

Related U.S. Application Data

[63] Continuation of Ser. No. 365,746, Jun. 13, 1989, abandoned.

[30] Foreign Application Priority Data

Jun. 14, 1988 [DE] Fed. Rep. of Germany ..... 3820225

[51] Int. Cl.[5] ..... B24B 49/00

[52] U.S. Cl. ..... 51/165.77; 51/165.72

[58] Field of Search ..... 51/165.77, 165.72, 284; 356/357, 358

[56] References Cited

U.S. PATENT DOCUMENTS 4,365,301 12/1982 Arnold et al. ..... 51/67 X
4,794,736 1/1989 Fuwa et al. ..... 51/165.72

FOREIGN PATENT DOCUMENTS 34043865 8/1980 Fed. Rep. of Germany .
3430499 2/1986 Fed. Rep. of Germany .

*Primary Examiner*—M. Rachuba
*Attorney, Agent, or Firm*—Merchant & Gould, Smith, Edell, Welter & Schmidt

[57] ABSTRACT

The invention concerns methods for the non-contacting measuring and, if necessary, abrasive machining of surfaces, in particular of large-surface mirrors or the like, with which, for determining contour deviations of the surface, the difference between interferometrically detected surface contour actual values and preselected surface contour desired values is determined. In accordance with the invention, measured interferometrically relative to a standard is a reference contour of at least one reference element, the extension of which corresponds essentially to a measuring and, if necessary, a machining region of a surface, the geometry of which is known to within the allowable contour tolerance of the surface. The surface to be measured is brought into a defined spatial location relative to the reference element, the separation of the reference contour from the measuring and/or machining region of the surface being detected incrementally by interferometric means, and the relative difference between actual and desired value is determined. Undertaken for the machining, if necessary, is a removal of material from the surface, the amount of which does not exceed the allowable contour tolerance.

Additionally, the invention concerns contrivances for carrying out these methods.

60 Claims, 4 Drawing Sheets

METHOD AND APPARATUS FOR NON-CONTACT MEASURING AND, IN CASE, ABRASIVE WORKING OF SURFACES

This is a continuation of application Ser. No. 365,746, filed June 13, 1989, now abandoned.

DESCRIPTION

The invention concerns methods for non-contacting measuring and, if necessary, abrasive (erosive) machining of surfaces, in particular for the superfine polishing of large-surface mirrors or the like, with which is determined the difference between the interferometrically detected surface contour actual values and preselected surface contour desired values and, if necessary, undertaken as a function of the result is a superficial removal of material.

The invention additionally concerns suitable apparatus for carrying out these methods.

Known machining methods serve for generating surfaces with a high degree of form fidelity even in the case of large surfaces. These methods find application, for example, in the production of reflection optics, in particular for astronomy; telescope mirrors form an example for the visible and infrared spectral region.

The form-faithful production, in particular of large-surface work pieces, presents special difficulties. This already applies when the surface is planar, spherical or rotation-symmetrically aspherical (for example parabolic). This applies particularly for nonrotation symmetric, aspherical surfaces. For a long time, there has been no satisfactory method for generating surfaces of this type.

Urgently needed are workpieces of this type, particularly in the field of astronomy. This is particularly applicable for the existing requirement of being able to produce economically non-rotation symmetric, aspherical segmental mirrors for large telescopes, with openings of several meters.

Up until the present time, for producing mirrors of this type one followed the classical method developed by Herschel, Ritchey, Anderson and others. Here, first produced, with large-area ground and polished bodies, is the best-approximation spherical form; the remaining variations from the desired form are then eliminated with small lapping and polishing disks. The polishing process must be interrupted several times for inspection of the achieved desired form, for which, up until now, the Foucault test represents the most reliable test method.

Already known from the German Patent 34 30 499 is a method and an apparatus for generating aspherical surfaces. Said to be used here is a flexible lapping or polishing tool that essentially simultaneously covers the entire workpiece surface to be machined and that lies against the workpiece with locally different pressures; the local differences of pressure are said to be selected corresponding to the variations in the surface of the workpiece from the desired form. This is realized by means of a membrane that covers the entire surface of the workpiece and that carries, on the workpiece side, a plurality of individual machining members. Out from the other side, the membrane, together with the machining members, is pressed against the surface by individually controllable pressure shoes. Form fidelity is said to be assured by controlling the individual pressure shoes relative to the machining pressure as well as by occasional measuring of the workpiece, with the membrane being brought, between each machining step, approximately into the desired form of the surface to be machined. Additionally, it can, for example, be impressed on a separate tool having approximately the desired form of the surface to be machined.

This method is not very well suited for producing larger, aspherical surfaces (approximately from 1 m up), because of the increasing uncertainty of the measuring system over the allowed tolerance range.

The object of the invention is to obtain a method for the non-contacting measuring of surfaces, in particular of large area mirrors or the like, that permits an exact measuring of arbitrarily shaped surfaces, with little expense.

It is the further object of the invention to indicate a method and an apparatus for the abrasive (erosive) machining of surfaces that permits also producing large surfaces, in form-faithful fashion, in the case of an arbitrary, also non rotation-symmetric, aspherical configuration.

Strived for here is a form fidelity which, relative to the diameter of the workpiece, excludes variations of more than $3\times10^{-8}$ m. This means that in the case of a mirror diameter of 1 m, for example, achieved will be a form fidelity that is better than 30 nanometers. Simultaneously achieved should be a microroughness of less than 10 Å rms. The machining of large-surface workpieces should be possible, understood under large surface being a ratio of diameter to mean radius of curvature of the workpiece that is typically less than 1 to 10. This means, for example, in the case of a mirror diameter of 1 m a mean radius of curvature of more than 10 m. The machining of arbitrarily shaped surfaces should be possible, so that besides planar, spherical, rotation-symmetrically aspherical, it is also possible to build non-rotation-symmetrically aspherical surface shapes in form-faithful fashion. Whether the surface curvature is concave or convex over the entire surface or alternates between concave and convex, as for example in the case of Schmidt disks, should play no role.

The machining of all polishable substrates should be possible, therefore, for example, the machining of glass substrates, in particular quartz glass; glass ceramic substrates, as for example Zerodur; ceramic substrates and metallic substrates.

Serving to meet these objectives are the features of the independent patent claims.

One characteristic of the invention lies in the concept that the actual contour of the work piece surface can be measured in-process and, if necessary, the machining tool can be controlled in-process until reaching the desired contour. The achievable contour fidelity, even in the case of very large-surface, non rotationally symmetric non-spheres, is better than 25 nanometers. In accordance with the invention, no stringent requirements are placed on the precisions of the method- and apparatus-relevant axes. There is no need for expensively controlling the machining tool relative to pressure, speed, alignment or infeed. It is not necessary to interrupt the machining process for purposes of inspection or even to remove the workpiece from the machining contrivance for this; to the contrary, quality control is done during the machining process itself.

In accordance with the invention, first constructed is a reference system, made up in particular of linear reference elements, for measuring the surface contour. This reference system can be located by surveying interferometrically against a standard whose geometry is known to the required precision. This reference system is integrated into the structure of the apparatus such that the initial surveying of the reference elements can be done by means of the same interferometers that also serve for measuring the surface. Obtained in this manner in particularly simple fashion is a direct tying of the measurement geometry to the precision of the linearity standard, which can also be realized relatively easily and with the required degree of accuracy (typically less than 10 nm), for example by means of a mercury surface.

Preferably used as interferometer measuring devices are scanning heterodyne interferometers that work with two closely neighboring wavelengths. The wavelength relationships correspond to a beat note. The heterodyne interferometers are particularly suitable because they are relatively insensitive to surface irregularities.

The invention enables not having to place any special requirements on the linearity of the method- and apparatus-relevant linear axes, from the horizontal as well as the vertical aspect. Linearities of 10 micrometers are completely adequate.

When the surface is not only to be measured but also to be abrasively machined, for example ground, the removal rate does not have to be known exactly, and a timed control of the pressure or a standard alignment of the machining tool is needed just as little.

If, preferentially, a rotary linear axis about which the work piece rotates relative to the measuring apparatus and the machining units, and if several radially-running linear axes are used along which the measuring and machining procedures run off, the radial deviation of the axis of rotation can lie in the magnitude of 10 micrometers.

The preferably-used heterodyne interferometers selectably serve for measuring, or for measuring the angle between workpiece surface and reference element. In the first case, achieved is a resolution of 1 nm, in the second case of 1/20 arc-seconds. With special advantage, in the case of abrasive machining of the workpiece surface, several measuring devices and machining units are suspended and/or supported in radially alternating fashion over the rotating workpiece. For example, capable of being used are three each measuring devices disposed 120° from one another and three machining units disposed 120° from one another, whereby the angle between one measuring device and the adjacent machining unit is 60°.

If only measuring is done, used will be a corresponding arrangement of three measuring devices disposed 120° from one another; the machining units can then be completely omitted, or are not actuated in the case of a measuring and machining apparatus.

The simultaneous utilization of several measuring systems produces a plurality of advantages, for example the possibility of a reciprocal control of the measuring devices; the recognition of disturbances, as for example vibrations, geometric changes in the supporting structure, air turbulence in the path of rays, spindle impact, etc.; continued work, even in the case of temporary breakdown of a measuring device and a totally, very much more rapid measuring and, if necessary, machining, in particular when used simultaneously one after the other in the direction of rotation are several measuring systems and, if necessary, machining arrangements.

Overall, the invention enables the measuring and forming of large-surface, also non-rotationally symmetric non-spheres, with a contour fidelity better than 25 nm. The invention is of striking conceptual simplicity, since it requires a minimum of axes, places no extraordinary requirements on precision of the axes, and an expensive control of the machining tool relative to pressure, speed, alignment and infeed is not needed. Because of the high degree of redundancy in the measuring arrangements, susceptibility to disturbance is slight, which, together with the possibility of autocontrol and fault recognition, guarantees a high degree of operational safety. Several individual parts, for example several mirror members of a segmental mirror, can be measured and, if necessary, machined simultaneously. The measuring and/or machining process does not have to be interrupted to enable inspection and checking of the surface quality; additionally, the workpiece does not have to be removed from the contrivance. In this manner, the invention enables a very rapid and very economical measuring and, if necessary, machining.

Explained in more detail in the following with the aid of the accompanying drawing will be preferred examples of embodiment of the invention. Shown in:

Figure 1:
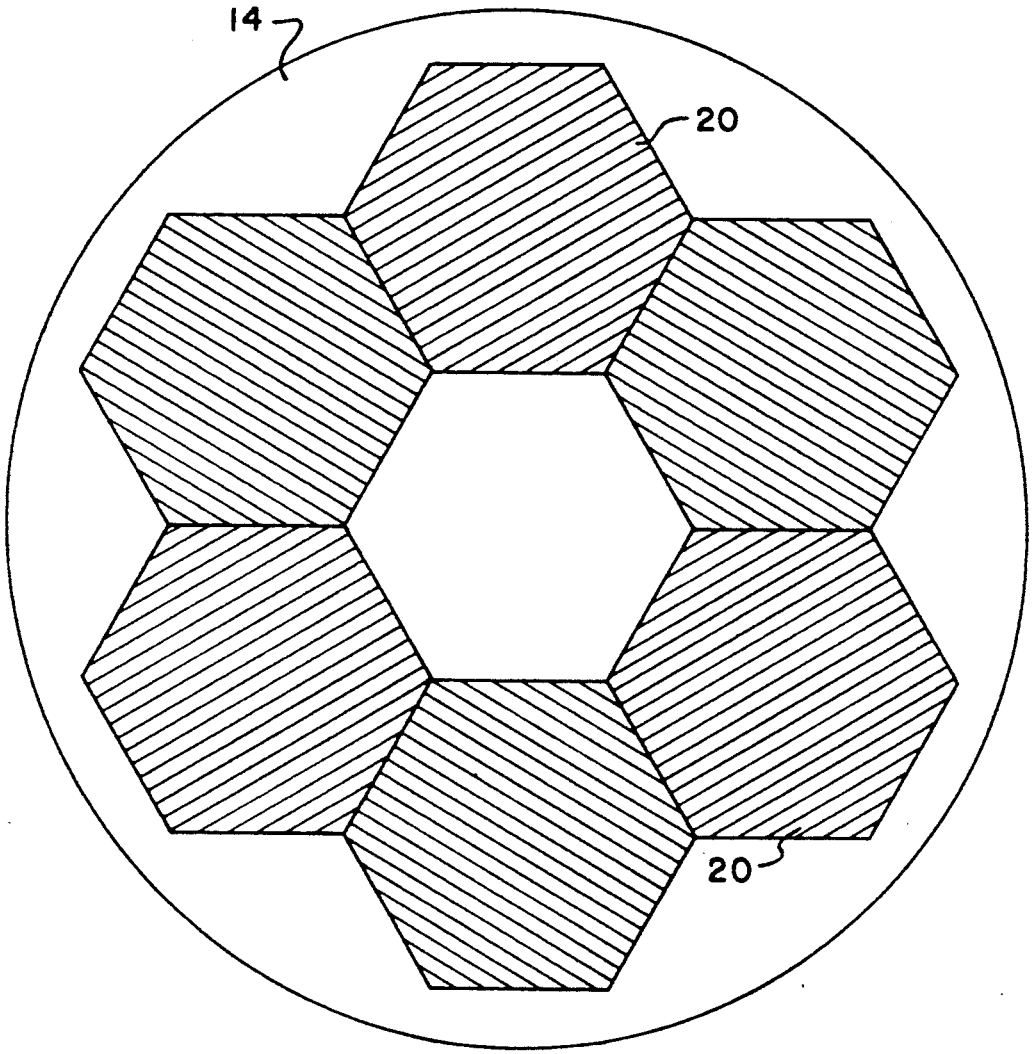
FIG. 1 is a peripheral arrangement of mirror segments on a round table of a measuring apparatus in accordance with the invention.
Figure 2:
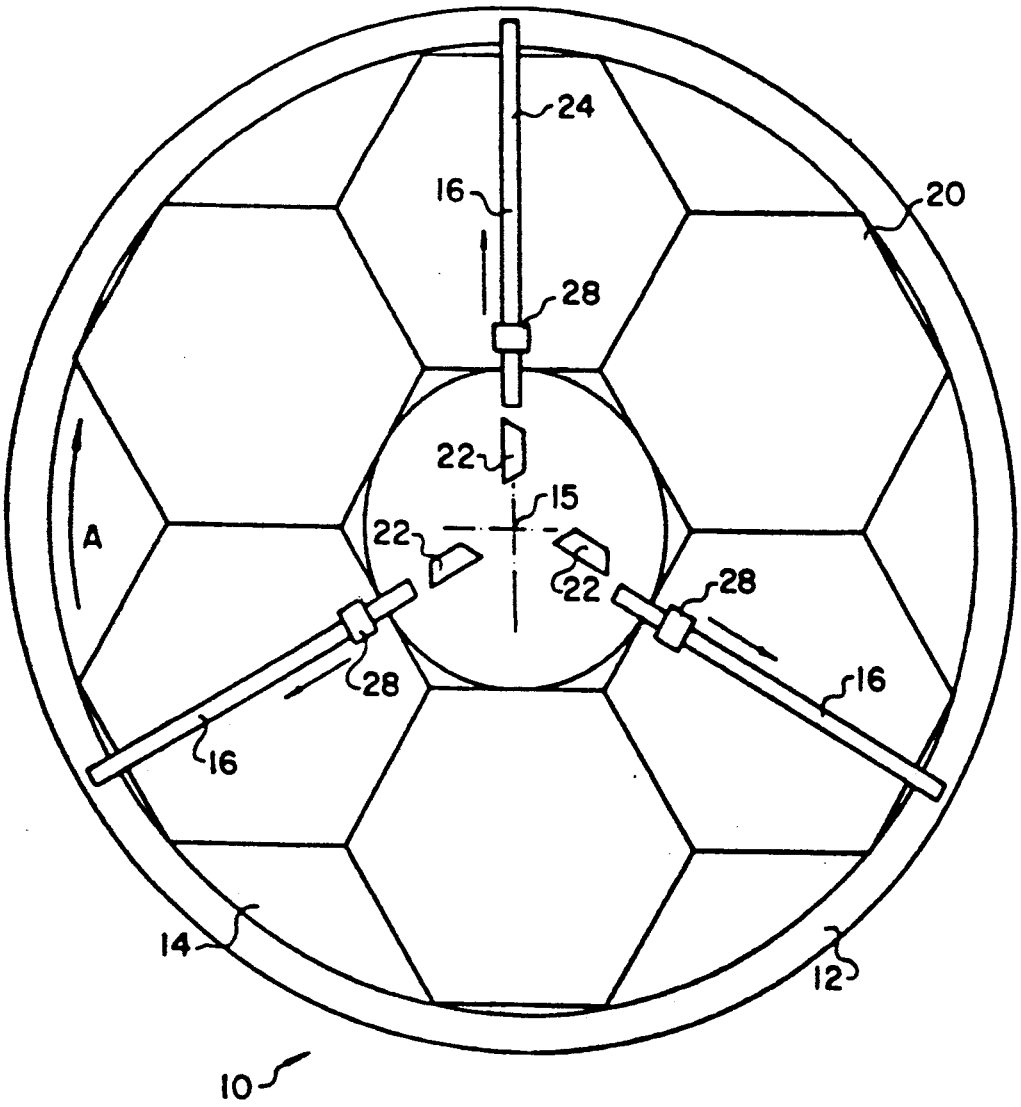
FIG. 2 is a schematic top view onto the apparatus in accordance with FIG. 1.

The apparatus in accordance with the invention that is shown in FIG. 1 and 2 comprises a large, round table supported on air bearings, on which are constructed the workpieces to be measured, in the example of embodiment several mirror segments 20 together with their supporting elements. The apparatus serving as the measuring machine 10 for these mirror elements 20 comprises a basic frame 12 in which is journaled a spindle 14 (FIG. 3), which carries the mirror segments. The spindle 14 is rotatable, relative to the basic frame, by means of a motor drive, about a central axis of rotation that is perpendicular to the plane of the drawing; this rotation takes place relatively slowly, for example at one revolution per minute. Additionally, joined with the spindle is an encoder (not represented) for determining the angular position of the spindle 14 relative to the basic frame 12. The encoder can be embodied as a glass scale (measure) and permits a precision of angle position determination within the range of 10 to 20 arc-seconds. The data determined by means of the encoder for setting the spindle are entered into a computer.

The measuring machine 10 is preferably set up in a vibration-decoupled, climatized clean room.

Provided above the surfaces 34 of the mirror segments 20 are measuring devices 16 that are firmly joined with the basic frame 12 and that are not concomitantly rotated with rotation of the spindle 14.

As FIG. 2 shows, provided are three measuring devices 16. The radial angle between two measuring devices is, in each case, 120°.

The measuring devices 16 are equipped with heterodyne interferometers. In the example of embodiment, these correspond to the Axiom Type 2/20 heterodyne interferometers of the Zygo company, however they are modified relative to the path of the rays.

Figure 3:
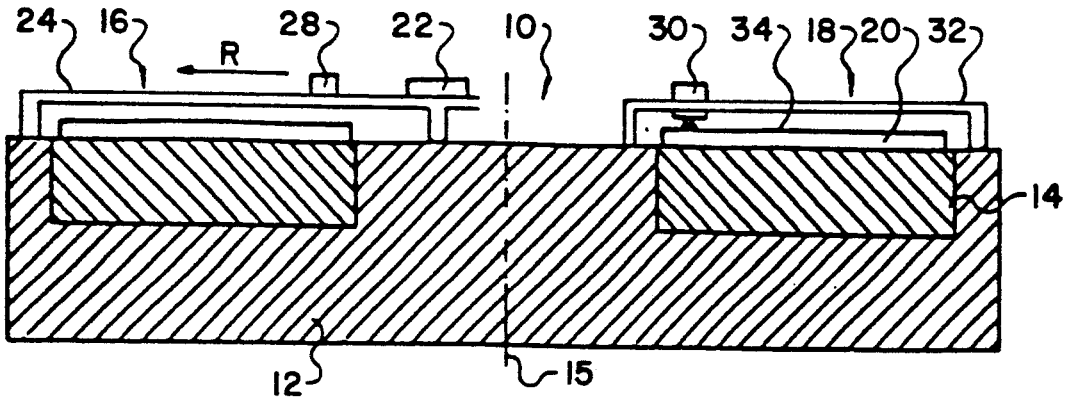
FIG. 3 is a side view in a cut of the apparatus in accordance with FIG. 1 and 2.
Figure 4:
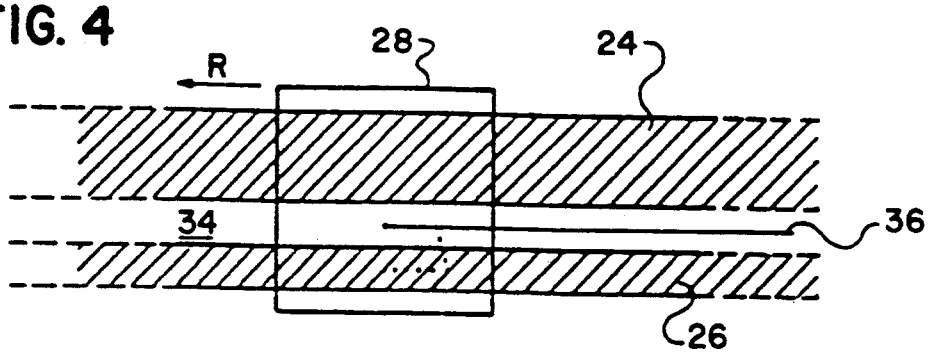
FIG. 4 is a schematic top view onto part of a measuring arrangement.
Figure 5:
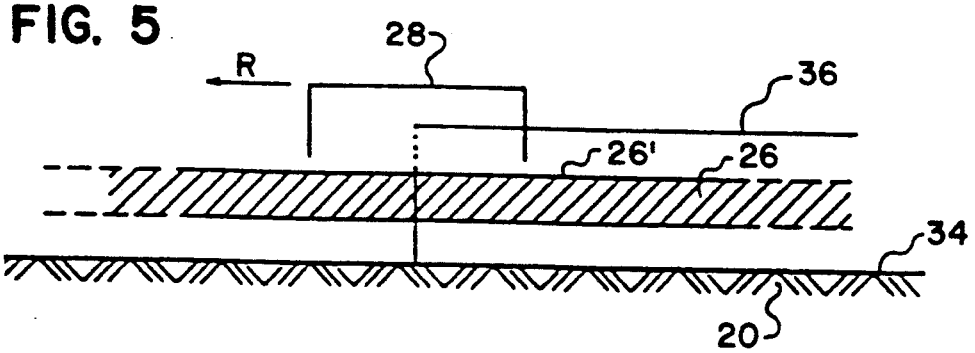
FIG. 5 is a schematic side view corresponding to FIG. 4.

A laser head and receiver 22 of each interferometer are arranged close to the axis of rotation of the spindle 14 such that the path of the rays from the laser is directed radially outwardly, as is given by the arrow R in FIG. 3 to 5. The path of the rays back to the receiver is directed radially inwardly.

Running radially outwardly along the path of the rays of the laser head/receiver 22 is a guideway 24 (FIG. 3), whereby the end of the guideway close to the axis of rotation can serve as a mounting support for the laser head/receiver 22.

A measuring head 28 of the heterodyne interferometer is displaceable in the radial direction along the guideway 24, so that it can be driven in the radial direction over the entire width of the mirror segment 20. Movement of the measuring head 28 is accomplished by means of contrivances that are known in the state of the art.

The linearity of the guideway 24, in the horizontal as well as the vertical aspect, is relatively uncritical; linearities of 10 μm suffice.

Extending along the guideway 24 is a glass measure, or the like, not shown in the Figure, serving as an encoder for the radial positioning of the measuring head.

Extending parallel next to the guideway 24, as FIG. 4 shows, is a reference element 26 that is formed, for example, by a polished Zerodur straightedge. The reference element 26 is suspended at a distance of a few millimeters over the surface 34 of the mirror segment 20 and, in the example of embodiment, is carried by the supports for the guideway 24 which, on one end, raise up from the basic frame 12 near the axis of rotation, at the other end at the outer circumference of the measuring machine 10.

Figure 6:
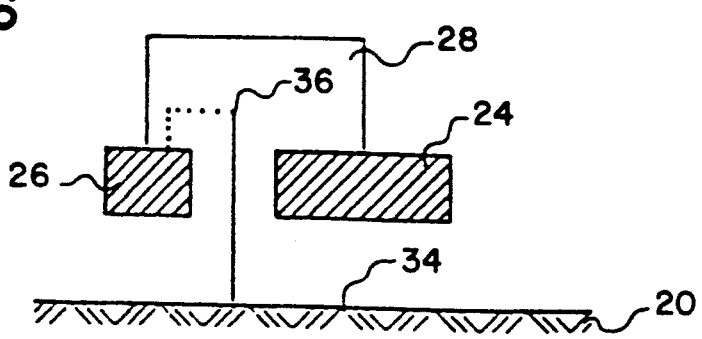
FIG. 6 is a rear view of the measuring arrangement in accordance with FIG. 4 and 5.

The measuring head 28 enables an interferometric measuring relative to the reference element 26 as well also to the surface 34, as is indicated in FIG. 4 to 6, on the one side by a dotted line, on the other by a solid line.

The data determined by the heterodyne interferometer are also entered into the computer mentioned.

The measuring procedure begins with surveying the reference elements by means of the associated heterodyne interferometer. The measuring head 28 is driven along the guideway 24 to the associated reference element 26 whose contour is at first known only to an approximation. Measuring is done relative to a linearity standard of known geometry, for example of a mercury surface, to a precision that is better than 10 nm.

In the event required, it is possible to monitor axial impact of the spindle, vibrations and the like, and corresponding measured data can be transmitted to the computer for compensation. For this purpose, it is possible to make use of additional, independent interferometers.

A wavelength compensator (not shown) having a resolution of, for example, $5\times10^{-9}$, establishes air pressure-dependent wavelength changes and enables a corresponding compensation of the measured data.

Occurring while measuring is the slow rotational movement of the spindle 14 that has been mentioned, so that, together with the radial, linear movement of the measuring head 28, the surface regions to be measured are passed over radially inwardly or outwardly in spiral fashion by the measuring devices. Because of the geometric conditions mentioned, the tolerances relative to the surface principal-plane are not very critical. Naturally, this does not hold for the tolerances in the direction perpendicular to the principal plane, i.e. the axial direction of the spindle 14.

While the surface to be measured moves through under the measuring device 16 as already stated, the actual contour is measured and stored in the computer.

In order that the interferometrically scanned workpiece and reference element surfaces not produce any erroneous measurements, the work pieces and reference elements must remain dust-free. For removing dust and the like, capable of being used is a cleaning contrivance, for example a vacuum contrivance (not shown) between the measuring devices.

Figure 7:
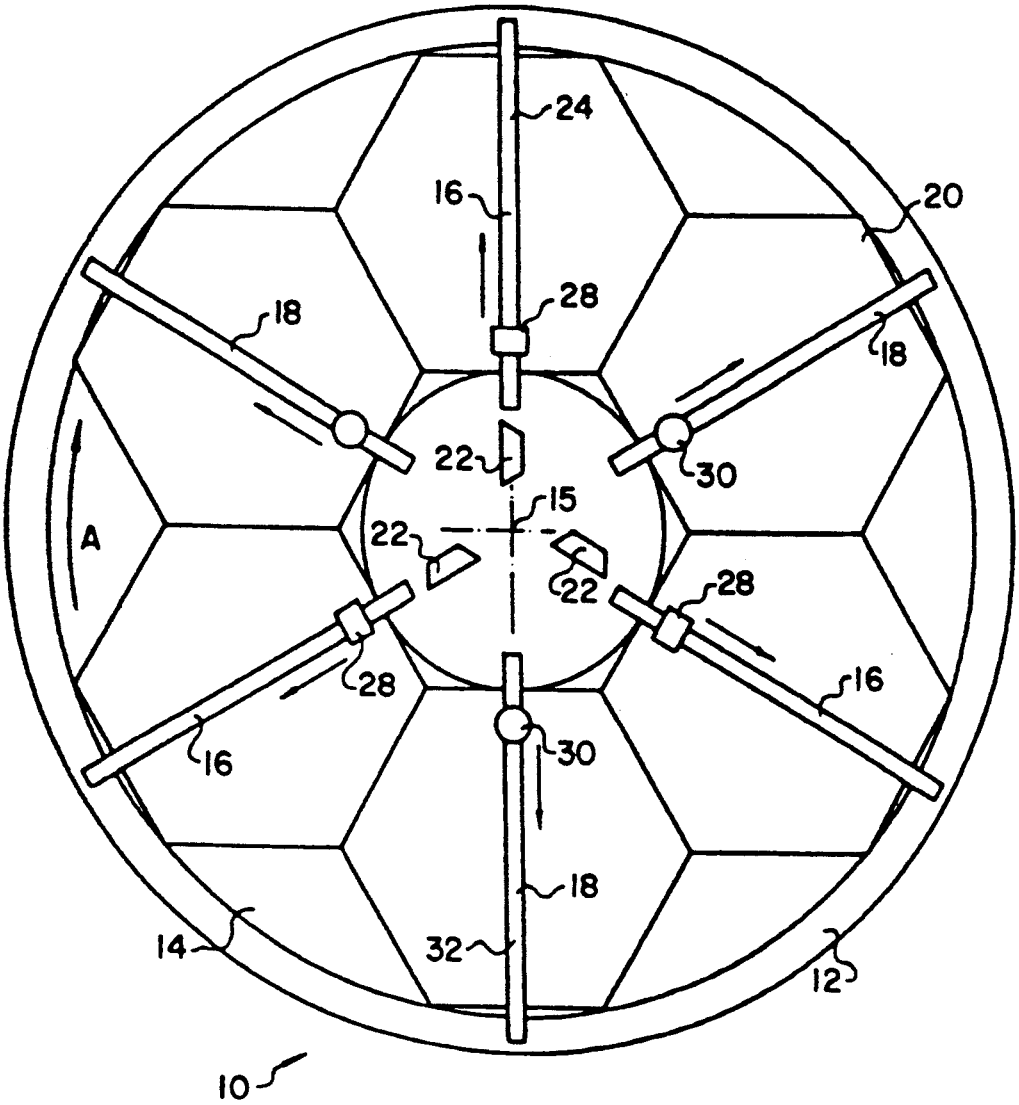
FIG. 7 is a schematic view onto a polishing contrivance in accordance with the invention and FIG. 8 is a side cut view of the polishing contrivance in accordance with FIG. 7.
Figure 8:
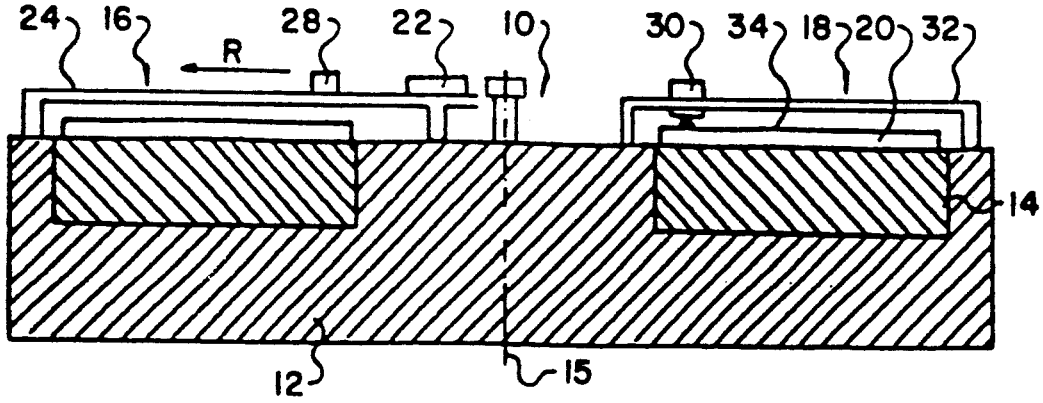

FIG. 7 and 8 show a polishing contrivance in accordance with the invention with which the machining method in accordance with the invention can be carried out.

In its basic construction, the polishing contrivance 10′ corresponds to the measuring apparatus already described with the aid of FIG. 1 to 6. Therefore, the parts shown in FIG. 7 and 8 bear the same reference numbers as for the parts in FIG. 1 to 6.

Compared to the measuring apparatus (FIG. 1 to 6), additionally added in the case of the polishing contrivance are only the machining units 18.

The machining units 18 are likewise firmly joined with the basic frame 12 and are not concomitantly rotated while rotating the spindle 14. In the example of embodiment, three machining units 18 are each disposed 120° apart, offset relative to the measuring devices 16 such that in each case there is one machining unit 18 between two measuring devices 16 and the angle between adjacent measuring devices 16 and machining units 18 amounts to exactly 60°.

Similarly as in the case of the measuring devices 16, the machining units 18 display a guideway 32 that runs above the surface 34 of the mirror segment 20 and is supported on the non-rotating part of the polishing machine 10′.

Capable of being driven over the entire radial stretch of the mirror element 20, along the guideway 32, is a polishing head 30. Size and shaping of the polishing pin of the polishing head 30 are adapted to the geometry of the surface to be machined.

Drive and adjustment of the polishing head 30 are effected by means of contrivances that are known in the state of the art; an encoder (not shown) that extends along the guideway 32, which can also be formed by a glass measure, enables establishing the relevant radial position of the polishing head 30. In operation, the polishing head 30, based on the data stored in the computer, is constantly held at the same distance from the axis of rotation 15 (center of the round table) as the associated interferometer measuring head 28, i.e. the measuring head of the measuring device 6 preceding in the machining direction A (FIG. 7). The polishing pins of the polishing heads 30 are set down on and/or lifted up from the surface in computer-controlled fashion. The machining pressure of the polishing pins on the surface is set such that the removal of material between two interferometer locations is at most equal to the allowable contour tolerance (e.g. 25 nm).

The machining process begins, like the already-described measuring procedure, with surveying of the reference elements 26. There follows the already-described measuring of the surface contour actual values and computer determination of the deviations from desired geometry of the surface.

With rotating motion of the spindle 14, formed are machining areas which, corresponding to the already-described areas of measurement, extend radially inwardly or outwardly in spiral fashion. The distance between the spiral paths corresponds to the travel distance by which the height of the crown of the mirror surface changes by one tolerance unit in the radial direction, relative to the reference element, for example by 25 nm. In the case of long focal-length parabolic segments, this typically amounts to a few tenths of millimeters, in the case of favorable construction of the reference elements, even only a few millimeters. These path intervals are established, relative to size and shape, with the choice of the polishing pins.

While the surface moves under the measuring device 16, its actual contour is measured and stored in the computer according to data. By means of these stored actual-contour data, accomplished is the control of the machining unit, therefore of the polishing head 30, that is following in the direction of machining A. In doing this, the removal rate is set such that the amount removed between two measuring units following one another in the machining direction A is less than the tolerance unit (e.g. 25 nm). This means that there never can be so much material removed between two measurement steps that the contour tolerance will be exceeded.

The measuring device 16, following the mentioned machining station in the machining direction A, establishes whether the preceding machining step has already brought the surface actual-contour into the tolerance range of the surface desired-contour. If this is the case, the next following machining station is not actuated in this machining area, so that there results no further removal.

The measuring and machining processes are repeated until all mirror segments have reached, within the tolerance range, the surface desired-contour.

The already-mentioned vacuum device advantageously serves, while machining, for eliminating the residues of removal.

Separating the measuring procedure from the associated machining procedure (i.e. in the case of the same surface area), from the point of view of time, makes it possible that local hot spots occurring from the machining will again recede before the next measurement, and air turbulence will decay.

If an interruption of machining at joints and cutouts between individual work pieces, for example mirror segments, is undesirable, full bodies can be inserted and concomitantly polished.

It is understood that the entire machining process is ended as soon as the measuring units establish having reached the desired contour for the entire surface.

We claim:

1. Method for the non-contacting measuring of surfaces, in particular of large-surface mirrors, with which, for determining contour deviations of the surface, established is the difference between interferometrically detected surface contour actual values and preselected surface contour desired values, characterized by the fact that a) a reference contour of at least one reference element, the extension of which corresponds essentially to a measuring region of the surface, is measured interferometrically relative to a standard whose geometry is known to within the allowable contour tolerance of the surface;

b) that the surface to be measured is brought into a defined spatial location relative to the reference element and c) the distance of the reference contour from the measuring region of the surface is detected incrementally by interferometric means and the relevant difference between actual value and desired value is determined.

2. Method according to claim 1, characterized by the fact that the reference element and the surface to be machined are moved relative to one another.

3. Method according to claim 2, characterized by the fact that the reference element lies on an imaginary radial line relative to a perpendicular axis of rotation through the principal plane of the surface, about which axis of rotation the surface is rotated, so that the essentially radially-running measuring region forms part of a spiral line on the surface.

4. Method according to claim 3, characterized by the fact that each spiral path formed from a measuring region corresponds to the spiral line of a distance over which the height of the crown of the surface changes by the amount of the contour tolerance, in the radial direction relative to the reference contour of the reference element.

5. Method according to claim 3, characterized by the fact that the measuring head of the interferometer is moved in incremental steps along the associated radial line, over the measuring region.

6. Method according to one of the claim 1, characterized by the fact that several reference elements, following one another at a distance, are used.

7. Method according to claim 1, characterized by the fact that determination of the actual and desired values is accomplished by means of laser interferometers and, if necessary, the influence of wavelength/air pressure dependency of the laser light is detected interferometrically, in real time, for correction.

8. Method according to claim 1, characterized by the fact that scanning heterodyne interferometers are used together with linear reference elements.

9. Method according to claim 1, characterized by the fact that the principal plane of the surface is aligned essentially horizontally relative to the direction of gravitation and the reference element is suspended or supported thereabove at a short distance from the surface.

10. Method according to claim 1, characterized by the fact that the interferometric detection processes, the calculations as well as the control and regulation processes when measuring are undertaken in automated fashion by means of a computer.

11. Method according to claim 10, characterized by the fact that the geometric desired data of the surface are calculated, respectively stored, by means of the computer.

12. Method for the non-contacting measuring and abrasive machining of surfaces, in particular for the superfine polishing of large-surface mirrors, with which is determined the difference between interferometrically detected surface contour actual values and preselected surface contour desired values, and a superficial removal of material being undertaken as a function of the results, characterized by the fact that a) a reference contour of at least one reference element, the extension of which corresponds essentially to a machining region of the surface, is measured interferometrically relative to a standard whose geometry is known to within the allowable contour tolerance of the surface;

b) that the surface to be machined is brought into a defined spatial location relative to the reference element and c) the distance of the reference contour from the machining region of the surface is detected incrementally by interferometric means, and the relevant difference between actual value and desired value is determined;

d) that, as a function of the results, subsequently undertaken in the machining region is a removal of material from the surface, the amount of which does not exceed the allowable contour tolerance, and e) detection in accordance with step c) and, if required, the machining in accordance with d) are repeated until the surface contour corresponds, within the tolerance, to the desired value.

13. Method according to claim 12, characterized by the fact that the removal of material is accomplished by at least one driven, controlled tool of a machining unit, in particular one or more polishing pins.

14. Method according to claim 12, characterized by the fact that the reference element and a machining unit are disposed at a fixed interval from one another and the surface to be machined is moved relative thereto, so that the machining region is successively brought into corresponding positions relative to the reference element and to the machining unit.

15. Method according to claim 14, characterized by the fact that the reference element and the machining unit lie on imaginary radial lines relative to a perpendicular axis of rotation through the principal plane of the surface, about which axis of rotation the surface is rotated, so that the essentially radial-running machining area forms part of a spiral line on the surface.

16. Method according to claim 15, characterized by the fact that each one of the spiral paths formed by the machining regions corresponds to the spiral line of a distance over which the height of the crown of the surface changes by the amount of the contour tolerance, in the radial direction relative to the reference contour of the reference element.

17. Method according to claim 15, characterized by the fact that at least one machining tool of the machining unit and the measuring head of the interferometer are moved in incremental steps associated to each other along the relevant radial lines.

18. Method according to claim 12, characterized by the fact that determination of the actual and desired values is accomplished by means of laser interferometers and, if necessary, the influence of wavelength/air pressure dependency of the laser light is detected interferometrically, in real time, for correction.

19. Method according to one of the claim 12, characterized by the fact that scanning heterodyne interferometers are used together with linear reference elements.

20. Method according to claim 12, characterized by the fact that the principal plane of the surface is aligned essentially horizontally relative to the direction of gravitation and the reference element is suspended or supported thereabove at a short distance from the surface.

21. Method according to claim 12, characterized by the fact that the interferometric detection processes, the calculations as well as the control and regulation processes are undertaken in automated fashion at the time of machining by means of a computer.

22. Method according to claim 21, characterized by the fact that the geometric desired data of the surface are calculated, respectively stored by means of the computer.

23. Apparatus for the non-contacting measuring of surfaces, in particular of large-surface mirrors, with a supporting structure accommodating the workpiece whose surface is to be measured and measuring devices for the interferometric detection of the surface contour, characterized by the fact that (a.) provided is at least one reference element (26) that extends, at some distance away, essentially parallel to a measuring region of the surface (34), said reference element having a reference contour measured interferometrically relative to a standard whose geometry is known to within the allowable contour tolerance of the surface;

(b.) associated to the reference element (26) is an interferometer measuring device (16) by means of which the reference element (26) is measured and the distance between the references element (26) and the measuring region is detected, (c.) provided are contrivances (14) for generating a relative movement between the workpiece (20) and the measuring device (16).

24. Apparatus according to claim 23, characterized by the fact that provided for accommodating the workpiece is a supporting structure (12, 14), with a principal plane of the surface lying essentially horizontally relative to the direction of gravitation.

25. Apparatus according to claim 24, characterized by the fact that the supporting structure is formed of a round table with a spindle (14) that is rotatable about a vertical axis of rotation.

26. Apparatus according to claim 24, characterized by the fact that the supporting structure and/or the round table displays an air bearing-supported spindle (14) that is associated to an encoder for determining the angular position of the spindle relative to the non-rotating supporting structure, with the spindle preferably displaying an axial impact (throw) of less than 0.1 arcseconds.

27. Apparatus according to claim 23, characterized by the fact that the supporting structure includes a basic frame (12) that is not concomitantly rotated in operation.

28. Apparatus according to claim 23, characterized by the fact that the measuring devices (16) are disposed in stationary fashion above the surface (34) of the workpiece (20), in particular being suspended and/or supported on the basic frame (12) and are not concomitantly rotated with rotation of the workpiece.

29. Apparatus according to one of the claim 23, characterized by the fact that in each case several like measuring devices (16) are provided, being provided in particular three measuring devices (16) separated by an angle of 120° about the axis of rotation of the round table.

30. Apparatus according to one of the claim 23, characterized by the fact that the measuring devices (16) are equipped with encoders like, for example, glass measures or the like for detecting the position, in particular the radial position of the relevant measuring head (28), with the encoders extending, in particular, along the guideways (24).

31. Apparatus according to one of the claim 23, characterized by the fact that the interferometer measuring devices (16) are constructed as scanning heterodyne interferometers, with, in particular the laser heads and receivers (22) being disposed near the axis of rotation of the round table and/or of the spindle (14).

32. Apparatus according to claim 23, characterized by the fact that provided is an interferometric wavelength compensator that detects air pressure-dependent wavelength changes for compensation.

33. Apparatus according to one of the claim 23 and 36, characterized by the fact that the reference elements (26) are substantially parallel to the associated guideway (24), and consists of elongated, mechanically form-stable bodies.

34. Apparatus according to claim 23, characterized by the fact that the reference elements (26) are suspended and/or supported at a distance of a few millimeters above the surface (34) to be machined.

35. Apparatus according to claim 23, characterized by the fact that there is provided a computer for storing the desired contour data, the actual contour measured data and for calculating the difference between the two.

36. Apparatus for the abrasive machining of surfaces, in particular for the superfine polishing of large-surface mirrors, with a supporting structure accommodating the workpiece whose surface is to be machined, at least one abrasive machining tool, contrivances for relative movement of the workpiece and machining tool, as well as contrivances for the interferometric detection of the surface contour, characterized by the fact that (a) provided is at least one reference element (26) that extends, at some distance, essentially parallel to a machining region of the surface (34), said reference element having a reference contour measured interferometrically relative to a standard whose geometry is known to within the allowable contour tolerance of the surface;

(b) associated to the reference element (26) is an interferometer measuring device (16) by means of which the reference element (26) is measured and the distance between the reference element (26) and the machining region is detected, (c) provided is at least one machining unit (18), separate form the measuring device (16), by means of which the machining tool (30) is capable of being moved abrasively over the entire machining region, and (d) provided are contrivances (14) for generating a relative movement between the workpiece (20) on the one hand, and the measuring device (16) as well as the machining unit (18) on the other hand, in order to successively bring the machining region with the measuring device (16) and the machining unit (18) into relative positions corresponding to one another.

37. Apparatus according to claim 36, characterized by the fact that provided is a supporting structure (12, 14), for accommodating the workpiece, with the surface principal planes lying essentially horizontal relative to the direction of gravitation.

38. Apparatus according to claim 37, characterized by the fact that the supporting structure is formed of a round table with a spindle (14) that is rotatable about a vertical axis of rotation.

39. Apparatus according to claim 37, characterized by the fact that the supporting structure and/or the round table displays an air bearing-supported spindle (14), to which is associated an encoder for determining the angular position of the spindle relative to the non-rotated supporting structure, with the spindle advantageously displaying an axial impact of less than 0.1 arc-seconds.

40. Apparatus according to claim 37, characterized by the fact that the supporting structure includes a basic frame (12) that is not concomitantly rotated in operation.

41. Apparatus according to one of the claim 36, characterized by the fact that the measuring devices (16) and the machining units (18) are disposed in stationary fashion above the surface (34) of the workpiece (20), in particular are suspended and/or supported on the basic frame (12) and are not concomitantly rotated with rotation of the workpiece.

42. Apparatus according to one of the claim 36, characterized by the fact that the measuring device and the machining unit display, in particular out from the axis of rotation, radially to over the outer limit of the surface (34) to be machined, guideways (24, resp. 32), along which, in one instance, the interferometer measuring head (28), in a second instance, the machining tool (30) can be driven.

43. Apparatus according to claim 36, characterized by the fact that provided in each case are several like, alternatingly disposed measuring devices (16) and machining units (18), there being provided in particular three measuring devices (16) angularly separated by 120° about the axis of rotation of the round table and three machining units (18) angularly separated 120° about the axis of rotation, such that measuring devices and machining units adjacent to one another lie at an angle of 60° from one another.

44. Apparatus according to one of the claim 36, characterized by the fact that the measuring devices (16) and the machining units (18) are provided with encoders such as, for example, glass measures or the like, for detecting the position, in particular the radial position of the relevant measuring head (28) and/or tool (30), with the encoder extending, in particular, along the guideways (24, resp. 32).

45. Apparatus according to claim 36, characterized by the fact that the interferometer measuring devices (16) are constructed as scanning heterodyne interferometers, with, in particular, the laser heads and receivers (22) being disposed near the axis of rotation of the round table and/or of the spindle (14).

46. Apparatus according to claim 36, characterized by the fact that there is provided an interferometric wavelength compensator that detects the air pressure-dependent wavelength changes for compensation.

47. Apparatus according to one of the claims 36 or 51, characterized by the fact that the reference elements (26) are substantially linear and extend parallel to the associated guideway (24) and consist of elongated mechanically form-stable bodies.

48. Apparatus according to claim 36, characterized by the fact that the reference elements (26) are suspended and/or supported at a distance of a few millimeters above the surface (34) to be machined.

49. Apparatus according to claim 36, characterized by the fact that there are provided electronic control contrivances for guiding the tool (30) toward the radial position of a measuring head (28) of the preceding measuring device (16), relative to the course of machining of the surface (34), as well as for setting the machining tool (30) down onto, respectively lifting it up from the surface (34).

50. Apparatus according to claim 36, characterized by the fact that there are provided pressure-setting contrivances for the machining tool (30) that allow adjusting the tool such that the amount of material removed in one machining step is, at most, equal to the allowable contour tolerance.

51. Apparatus according to one of the claim 36, characterized by the fact that there is provided at least one additional independent interferometer for detecting the axial impact of the spindle, for detecting vibrations of the apparatus and the like.

52. Apparatus according to one of the claim 36, characterized by the fact that there is provided a computer for storing the desired value data, the actual value measured data, for calculating the difference between the two and for controlling the machining unit (18) associated to the relevant measuring device (16).

53. Apparatus according to one of the claim 36, characterized by the fact that there is provided a cleaning, in particular a vacuum contrivance, for carrying off the residues of material removed from the surface.

54. Method for non-contacting measuring of surfaces, in particular of large-surface mirrors, with which, for determining contour deviations of the surface, established is the difference between interferometrically detected surface contour actual values and preselected surface contour desired values, characterized by the fact that (a) a reference contour of at least one reference element, the extension of which corresponds essentially to a measuring region of the surface, is measured interferometrically relative to a standard whose geometry is known to within the allowable contour tolerance of the surface;

(b) that the surface to be measured is initially polished, as preparation, to a contour correctness in the range of $10^{-6}$ m. and is brought into a defined spatial location relative to the reference element and (c) the distance of the reference contour from the measuring region of the surface is detected incrementally by interferometric means and the relevant difference between actual value and desired value is determined.

55. Method for the non-contacting measuring and abrasive machining of surfaces, in particular for the superfine polishing of large surface mirrors, with which is determined the difference between interferometrically detected surface contour actual values and preselected surface contour desired values, and a superficial removal of material being undertaken as a function of the results, characterized by the fact that (a) a reference contour of at least one reference element, the extension of which corresponds essentially to a machining region of the surface, is measured interferometrically relative to a standard whose geometry is known to within the allowable contour tolerance of the surface;

(b) that the surface to be machined is brought into a defined spatial location relative to the reference element and (c) the distance of the reference contour from the machining region of the surface is detected incrementally by interferometric means, and the relevant difference between actual value and desired value is determined, said step (c) including the use of several reference elements and machinery units one after the other in alternating fashion;

(d) that, as a function of the results, subsequently undertaken in the machining region is a removal of material from the surface, the amount of which does not exceed the allowable contour tolerance, and (e) detection in accordance with step (c) and, if required, the machining in accordance with (d) are repeated until the surface contour corresponds, within the tolerance, to the desired value.

56. Method for the non-contacting measuring and abrasive machining of surfaces, in particular for the superfine polishing of large surface mirrors, with which is determined the difference between interferometrically detected surface contour actual values and preselected surface contour desired values, and a superficial removal of material being undertaken as a function of the results, characterized by the fact that (a) a reference contour of at least one reference element, the extension of which corresponds essentially to a machining region of the surface, is measured interferometrically relative to a standard whose geometry is known to within the allowable contour tolerance of the surface;

(b) that the surface to be machined is initially polished, as preparation, to a contour correctness in the range of $10^{-6}$ m, and is brought into a defined spatial location relative to the reference element and (c) the distance of the reference contour from the machining region of the surface is detected incrementally by the interferometric means, and the relevant difference between actual value and desired value is determined;

(d) that, as a function of the results, subsequently undertaken in the machining region is a removal of material from the surface, the amount of which does not exceed the allowable contour tolerance, and (e) detection in accordance with step (c) and, if required, the machining in accordance with (d) are repeated until the surface contour corresponds, within the tolerance, to the desired value.

57. Apparatus for the non-contacting measuring of surfaces, in particular of large-surface mirrors, with a supporting structure accommodating the workpiece whose surface is to be measured and measuring devices for the interferometric detection of the surface contour, characterized by the fact that (a) provided is at least one reference element (26) that extends, at some distance away, essentially parallel to a measuring region of the surface (34), said reference element having a reference contour measured interferometrically relative to a standard whose geometry is know to within the allowable contour tolerance of the surface;

(b) associated to the reference element (26) is an inteferometer measuring device (16) by means of which the reference element (26) is measured and the distance between the reference element (26) and the measuring region is detected; said measuring device includes a guideway (24) running out horizontally, in particular form the axis of rotation, radially up to over the outer limit of the surface (34) to be machined, along which the interferometer measuring head (28) can be driven;

(c) provided are contrivances (14) for generating a relative movement between the workpiece (20) and the measuring device (16).

58. Apparatus for the non-contacting measuring of surfaces, in particular of large-surface mirrors, with a supporting structure accommodating the workpiece whose surface is to be measured and measuring devices for the interferometric detection of the surface contour, characterized by the fact that (a) a reference element (26) that extends, at some distance away, essentially parallel to a measuring region of the surface (34), said reference element having a reference contour measured interferometrically relative to a standard whose geometry is known to within the allowable contour tolerance of the surface;

(b) associated to the reference element (26) is an inteferometer measuring device (16) by means of which the reference element (26) is measured and the distance between the reference element (26) and the measuring region is detected;

(c) a second independent interferometer for detecting the axial impact of the spindle, for detecting vibrations of the apparatus and the like; and (d) contrivances (14) for generating a relative movement between the workpiece (20) and the measuring device (16).

59. Apparatus according to claim 33, wherein said elongated mechanically form-stable bodies include a polished Zerodur straightedge.

60. Apparatus according to claim 47, wherein said elongated mechanically form-stable bodies include a polished Zerodur straightedge.

* * * * *